US005144277A

United States Patent [19]

Ishihara et al.

[11] Patent Number: 5,144,277

[45] Date of Patent: Sep. 1, 1992

[54] SEALING STRUCTURE FOR ELECTRICAL PARTS

[75] Inventors: Kanji Ishihara; Tsumoru Oka, both of Miyagi, Japan

[73] Assignee: Alps Electric Co., Ltd., Tokyo, Japan

[21] Appl. No.: 697,565

[22] Filed: May 9, 1991

[30] Foreign Application Priority Data

May 11, 1990 [JP] Japan ..... 2-48540[U]

[51] Int. Cl.[5] ..... H01C 10/32; H01C 10/36

[52] U.S. Cl. ..... 338/164; 338/172

[58] Field of Search ..... 338/164, 162, 172, 173, 338/174

[56] References Cited

U.S. PATENT DOCUMENTS 4,933,661 6/1990 Oda et al. ..... 338/174

*Primary Examiner*—Marvin M. Lateef

*Attorney, Agent, or Firm*—Guy W. Shoup; B. Noel Kivlin

[57] ABSTRACT

The present invention relates to a rotary type electrical part and particularly to a throttle position sensor used within an automobile. The electrical part comprises a casing having one end thereof defined as an opening face, an attachment hole defined in the other end thereof, and a hollow cylindrical body formed therein which extends at right angles to the side of the casing, the casing further having an air passage which is defined in the side thereof and communicates with a hollow portion of the cylindrical body, a driving shaft having one end projecting from the attachment hole and rotatably mounted within the casing, a sliding-element receive attached to the other end of the driving shaft and rotated in response to the rotation of the driving shaft, an insulating substrate disposed adjacent to the sliding-element receiver in the casing and in an opposing relationship thereto and having a conductive pattern formed on the surface of the insulating substrate, the conductive pattern disposed in an opposing relationship to the sliding-element receiver, sliding elements mounted on the sliding-element receiver in such a manner that the sliding elements are brought into sliding contact with the insulating substrate in a face-to-face manner, and a connector having contacts whose outer side is provided with a sealing member mounted thereon and whose tip portions are received with terminals fixed to the conductive pattern inserted therein. In addition, a cover is fitted onto the opening face of the casing and a filler material is charged into a region between the cover and the inner-wall face of the casing, and an opening face of the cylindrical body is sealed tight with the sealing member after press-fitting of the connector into the cylindrical body.

3 Claims, 4 Drawing Sheets

SEALING STRUCTURE FOR ELECTRICAL PARTS

BACKGROUND OF THE INVENTION

1. Field of the Invention

The present invention relates to a sealing structure suitable for use in rotary type electrical parts such as rotary type variable resistors and rotary switches.

2. Description of the Related Art

Rotary operation type electrical parts are finding wider use in various fields. It often happens that a vehicle, for example, is provided with an electrical device referred to as a throttle position sensor in order to set the optimal amount of feeding of fuel according to the running speed of the vehicle and to run the vehicle at the optimal fuel consumption. One type of throttle position sensor, that includes a sliding-element receiver to which sliding elements are attached is connected to a rotary shaft and is rotated according to the degree of depression of an accelerator pedal in such a way that they are rotated integrally with each other. The degree of rotation of the rotary shaft corresponding to the degree of depression of the accelerator pedal is detected as variations in resistance values by providing a substrate having a resistance body and a collecting body both formed onto the surface thereof in an opposing relationship to the sliding-element receiver and bringing the sliding elements into sliding contact with the resistance body and the collecting body.

This type of throttle position sensor is disclosed in Japanese Utility Model Application Laid-Open No. 62-47104, for example. FIG. 4 is a fragmentary cross-sectional view of a throttle position sensor. FIG. 5 is a plan view of a cover.

Referring to FIG. 4, designated at numeral 1 is a case which forms a casing for the throttle position sensor. The case 1 is fixedly mounted in a bonnet of a vehicle, for example. An accommodating portion 2 for accommodating respective members which constitute a rotary type variable resistor is defined in the case 1. In addition, an opening 3 for the attachment of the respective members is defined in one side of the accommodating portion 2.

An attachment hole 4 is defined in a position opposite to a position where the opening 3 of the case 1 is defined. A bearing bush 5 is inserted into and fitted in the attachment hole 4. In addition, a driving shaft 6 is rotatably inserted into and fitted in the bearing bush 5. One end of the driving shaft 6 extends outwardly of the case 1 and is connected to an accelerator pedal (not shown) so as to be rotated by the degree of rotation thereof corresponding to the degree of depression of the accelerator pedal. In addition, the other end of the driving shaft 6 extends in the accommodating portion 2 and is mounted so as to be rotatable integrally with a sliding-element receiver 7. Sliding elements 8*a*, 8*b* are mounted on the surface of the sliding-element receiver 7. Each of the sliding elements 8*a*, 8*b* is brought into sliding contact with a resistance body 10*a* and a collecting body 10*b* both formed onto the surface of a substrate 9 provided in an opposing relationship to the sliding-element receiver 7.

Designated at numeral 11 is a cover for covering the opening 3 of the accommodating portion 2. The cover 11 is comprised of an insulating material such as synthetic resin, etc. The substrate 9 is positioned by fitting the cover 11 onto the opening 3 in a state in which the substrate 9 is brought into sliding contact with a step portion 1*a* formed on an inner-wall face of the case 1. The sliding-element receiver 7 is urged by a wave washer 12 in a direction in which the respective sliding elements 8*a*, 8*b* thereof are brought into sliding contact with the resistance body 10*a* and the collecting body 10*b* respectively. Therefore, the sliding elements 8*a*, 8*b* are brought into sliding contact with the resistance body 10*a* and the collecting body 10*b*, respectively, in a good condition. The cover 11 has a ventilating cylinder 13 which projects from the outer peripheral wall of the cover 11. The axial length of the ventilating cylinder 13 is set in such a manner that the tip portion of the ventilating cylinder 13 slightly projects from an open end of the opening 3 in the case 1. As shown in FIG. 5, an air passage 14 is defined in the inner side face of the cover 11. In addition, one side end of the air passage 14 communicates with an air-flow passage 16 defined inside the ventilating cylinder 13 by way of a through-hole 15, whereas the other side end thereof communicates with the accommodating portion 2 by way of a concave portion 17. A resin well 18 is formed in the course of the air passage 14. The air passage 14 is divided into a passage portion 14*a* directed from the well 18 to the side of the ventilating cylinder 13 and a passage portion 14*b* directed to the side of the concave portion 17. In the present embodiment, the passage portion 14*a* is placed at an angle of 90° with respect to the passage portion 14*b*.

Furthermore, holes 20 for guiding air take-out terminals 19 connected to both ends of the resistance body 10*a* and the collecting body 10*b* into the outside are defined within the concave portion 17 of the cover 11. The take-out terminals 19 are electrically connected to their associated signal lines 21 at the outside of the cover 11, and the respective signal lines 21 are inserted into a take-off insulator 22.

Designated at numeral 23 in the drawing is a thermosetting filler material such as epoxy resin. The filler material 23 is charged into a region between the inner-wall face of the case 1 and the outer periphery of the ventilating cylinder 13 in such a manner that the outer peripheral wall of the cover 11 is covered with the filler material 23, thereby sealing between the outer peripheral wall of the cover 11 and the inner-wall face of the case 1, and the holes 20. In addition, the filler material 23 serves to protect the terminals 19 and the signal lines 21 connected thereto from conducting in a state in which they are embedded therein. Further, designated at numeral 24 is a hot-melt injection material comprised of melt thermoplastic resin injected into the ventilating cylinder 13. Thus, the inside of the ventilating cylinder 13 is sealed by the hot-melt injection material 24, and the accommodating portion 2 in the opening 3 of the case 1 is structurally held in a tightly-sealed manner by making use of the thermosetting filler material 23 and the hot-melt injection material 24.

Finally, designated at numeral 25 in the drawing is a sealing member for sealing tight between the bearing bush 5 and the driving shaft 6.

The structure of the above-described conventional arrangement has the problem in that since the thermosetting filler material 23 must be charged into the region between the inner-wall face of the case 1 and the outer peripheral wall of the ventilating cylinder 13, and the hot-melt injection material 24 must be charged into the ventilating cylinder 13, two steps are required, thereby causing poor workability. In addition, the airtightness cannot be checked after the hot-melt injection material 24 is charged into the ventilating cylinder 13 in the above-described manner.

SUMMARY OF THE INVENTION

With the foregoing problem in view, it is a principal object of the present invention to provide a sealing structure suitable for use in rotary-type electrical parts which can provide superb workability and permit checking of the airtightness after resin is charged thereinto.

It is another object of the present invention to provide a sealing structure suitable for use in electrical parts which comprises a casing having one end thereof defined as an opening face, an attachment hole defined in the other end thereof, and a hollow cylindrical body formed therein which extends at right angles to the side of the casing, the casing further having an air passage which is defined in the side thereof and communicates with a hollow portion of the cylindrical body, a driving shaft having one end projecting from the attachment hole and rotatably mounted within the casing, a sliding-element receiver attached to the other end of the driving shaft and rotated in response to the rotation of the driving shaft, an insulating substrate disposed adjacent to the sliding-element receiver in the casing and in an opposing relationship thereto and having a conductive pattern formed on the surface of the insulating substrate, the conductive pattern disposed in an opposing relationship to the sliding-element receiver, sliding elements mounted on the sliding-element receiver in such a manner that the sliding elements are brought into sliding contact with the insulating substrate in a face-to-face manner, and a connector having contacts whose outer side is provided with a sealing member mounted thereon and whose tip portions are received with terminals fixed to the conductive pattern inserted therein, whereby a cover is fitted onto the opening face of the casing and a filler material is charged into a region between the cover and the inner-wall face of the casing, and an opening face of the cylindrical body is sealed tight with the sealing member after press-fitting of the connector into the cylindrical body.

It is a further object of the present invention to provide the sealing structure wherein a sealing ring is provided between the driving shaft and the casing.

It is a still further object of the present invention to provide the sealing structure wherein the sealing member is a bellows-shaped rubber packing and serves to seal the opening face of the cylindrical body.

According to the arrangement of the present invention as described above, the sealing of the inside of the case is performed by simply charging the filler material into the region between the cover and the inner-wall face of the case and press-fitting the connector into the cylindrical body mounted onto the side of the case. Thus, the workability for its sealing is excellent. Since the air passage, which communicates with the cylindrical hollow portion, is defined in the side of the case, the airtightness of the inside of the case can be checked by injecting high-pressurized air from the air passage after the filler material is charged into the region between the cover and the inner-wall face of the case.

The present invention can bring about an advantageous effect in that since a resin-sealing process can be reduced to one time as compared with a conventional double resin-sealing process, the efficiency in the resin-sealing work is increased and even after the portion for accommodating the respective parts is blocked with a resin, the airtightness of the parts accommodating portion can be checked.

The above and other objects, features and advantages of the present invention will become apparent from the following description and the appended claims, taken in conjunction with the accompanying drawings in which a preferred embodiment of the present invention is shown by way of illustrative example.

BRIEF DESCRIPTION OF THE DRAWINGS

FIGS. 1 through 3 are diagrams each showing one embodiment of the present invention, in which:

FIG. 1 is a fragmentary cross-sectional view of a throttle position sensor in a state before a connector is press-fitted into a casing;

FIG. 2 is a fragmentary cross-sectional view of the throttle position sensor in a state in which the connector is press-fitted into the casing; and FIG. 3 is an exploded perspective view of the throttle position sensor; and FIGS. 4 and 5 are diagrams each showing a conventional example, in which:

FIG. 4 is a fragmentary cross-sectional view of a throttle position sensor; and FIG. 5 is a plan view of a cover.

DETAILED DESCRIPTION OF THE PREFERRED EMBODIMENTS

A preferred embodiment of the present invention will hereinafter be described with reference to the accompanying drawings.

Figure 1:
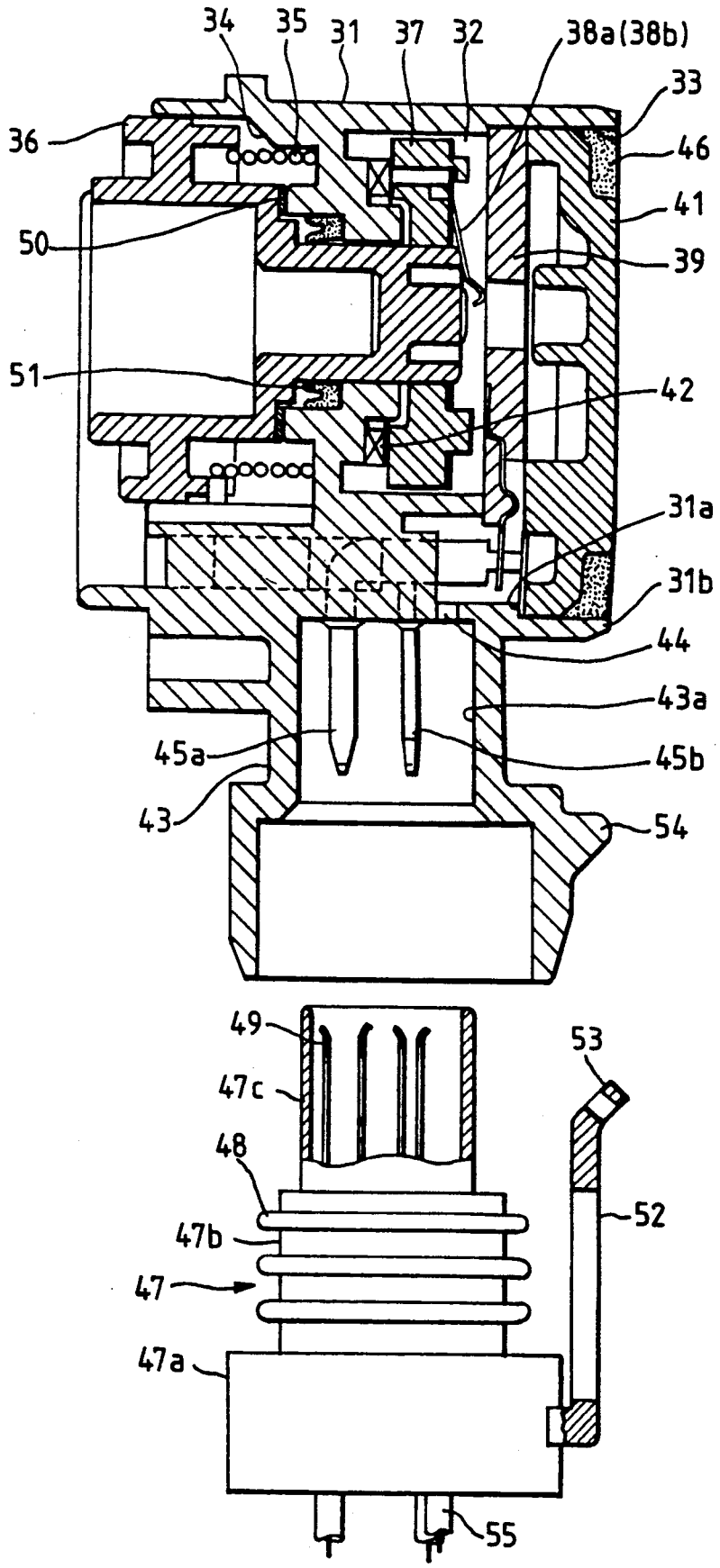
Figure 2:
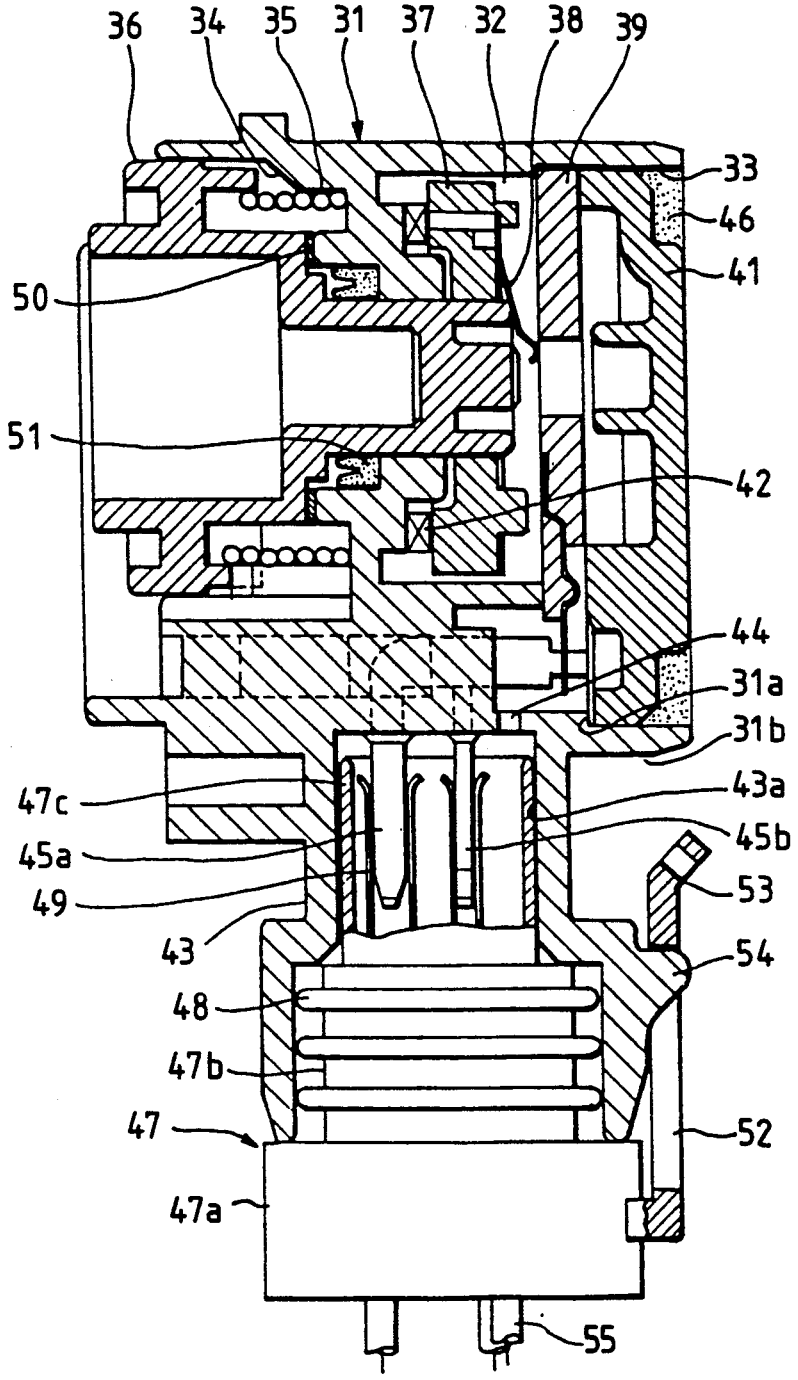
Figure 3:
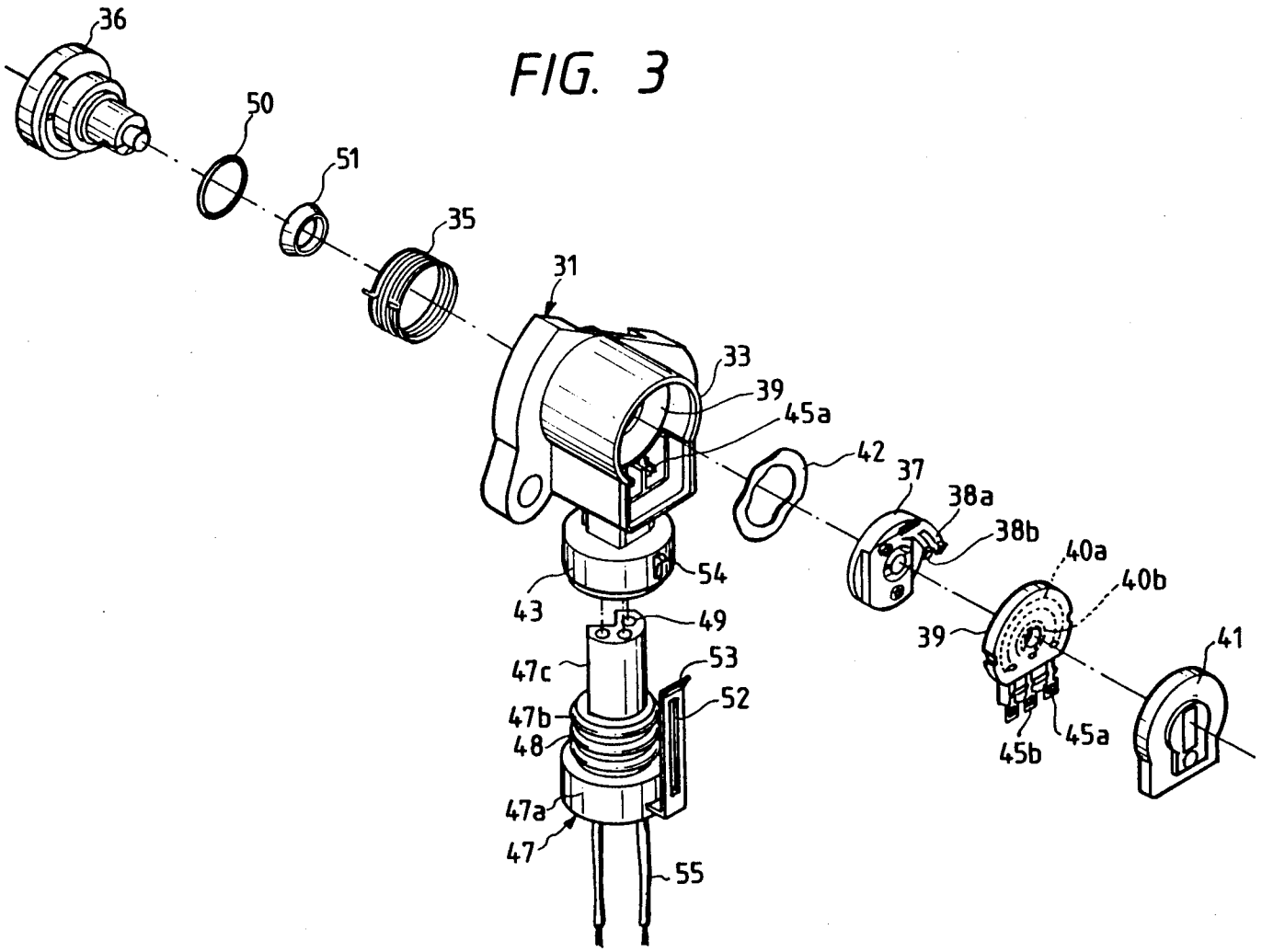
Figure 4:
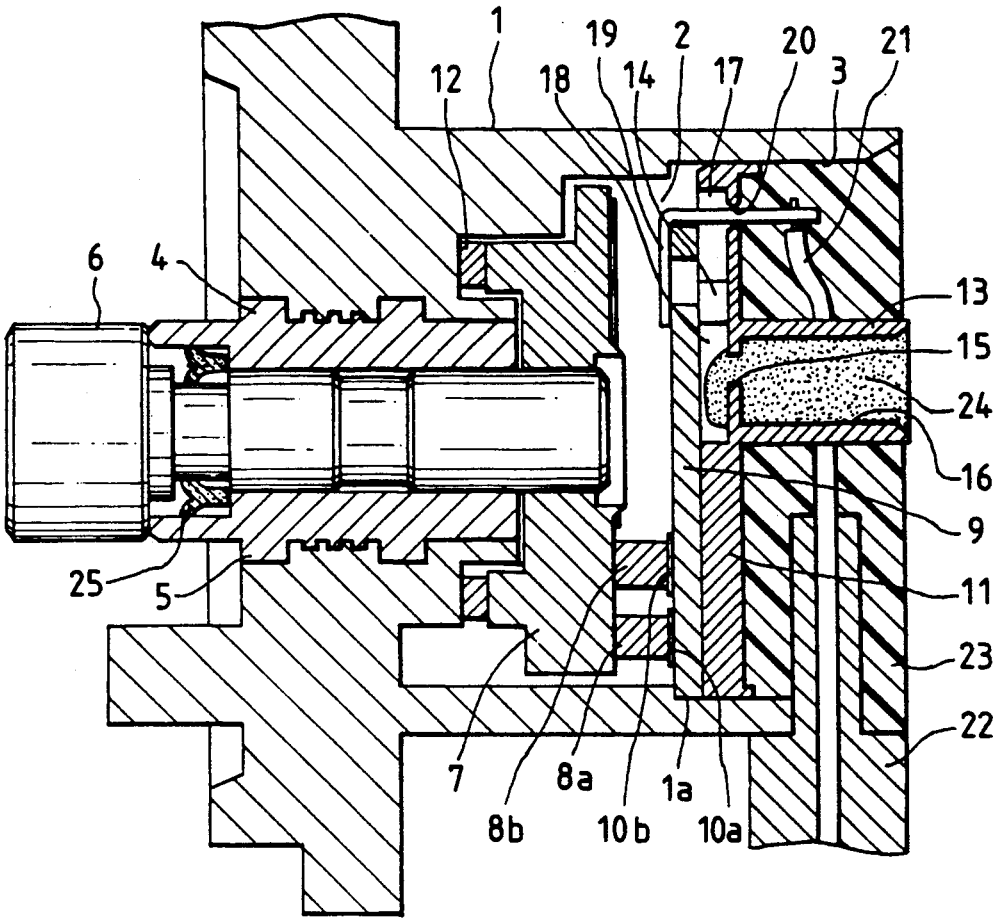
FIG. 4 PRIOR ART
Figure 5:
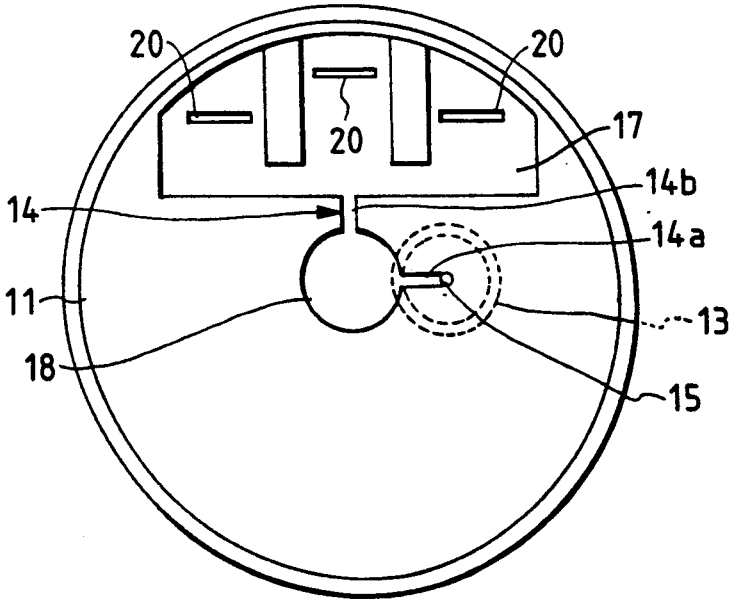
FIG. 5 PRIOR ART

FIGS. 1 through 3 are diagrams each showing one embodiment of the present invention. In the same drawings, FIG. 1 is a fragmentary cross-sectional view of a throttle position sensor before insertion of a connector into a casing. FIG. 2 is a fragmentary cross-sectional view of the throttle position sensor in a state in which the connector is inserted into the casing in FIG. 1. FIG. 3 is an exploded perspective view of the throttle position sensor.

Referring to FIGS. 1 through 3, designated at numeral 31 is a case which forms a casing for a throttle position sensor. The case 31 is fixedly mounted inside a bonnet of an automobile, for example. The case 31 has an accommodating portion 32 defined therein for accommodating respective members which constitute a rotary variable resistor. An opening 33 for inserting the respective members therethrough is defined in one end of the accommodating portion 32.

An attachment hole 34 is defined in a position opposite to a position where the opening 33 of the case 31 is formed. A driving shaft 36 is rotatably inserted into and fitted in the attachment hole 34 through a spring 35. One end of the driving shaft 36 extends outwardly of the case 31 and serves to rotate by the degree corresponding to the degree of depression of an accelerator pedal.

The other end of the driving shaft 36 extends in the accommodating portion 32 and is mounted so as to be rotatable integrally with a sliding-element receiver 37. Sliding elements **38*a*, 38*b* are mounted on the surface of the sliding-element receiver 37. Each of the sliding elements 38*a*, 38*b* is brought into sliding contact with a resistance body 40*a* and a collecting body 40*b* both formed onto the surface of an insulating substrate 39 provided in an opposing relationship to the sliding-element receiver 37**.

Designated at numeral 41 is a cover for covering the opening 33 of the accommodating portion 32. The cover 41 is comprised of an insulating material such as synthetic resin, etc. The insulating substrate 39 is positioned by fitting the cover 31 onto the opening 33 in a state in which the insulating substrate 39 is brought into sliding contact with a step portion 31*a* formed on an inner-wall face of the case 31. The sliding-element receiver 37 is urged by a wave washer 42 in a direction in which the respective sliding elements 38*a*, 38*b* thereof are brought into contact with the resistance body 40*a* and the collecting body 40*b*, respectively. Therefore, the sliding elements 38*a*, 38*b* are slid on the resistance body 40*a* and the collecting body 40*b*, respectively, in a good condition.

In addition, a cylindrical body 43 having a non-circular hollow portion 43*a* defined therein projects from an outer side wall 31*b* of the case 31. An air passage 44 is defined in the outer side wall 31*b* in such a way that the hollow portion 43*a* of the cylindrical body 43 communicates with the accommodating portion 32 of the case 31. In the periphery of the air passage 44, terminals 45*a*, 45*b* connected to the resistance body 40*a* and the collecting body 40*b* extend through the outer side wall 31*b* so as to project toward the hollow portion 43*a*.

In the drawing, designated at numeral 46 is a thermosetting filler material such as epoxy resin. The filler material 46 is charged into a region between the outer periphery of the cover 41 and the inner-wall face of the case 31 so as to seal between the outer periphery of the case 31 and the inner-wall face thereof.

Designated at numeral 47 is a connector comprised of resin which is press-fitted into the hollow portion 43*a* of the cylindrical body 43. The connector 47 comprises a lead attachment portion 47*a* having a large diameter, a cylindrical portion 47*b* having a small diameter, and a non-circular portion 47*c*. A sealing member, for example, a bellows-shaped rubber packing 48, is mounted on the non-circular portion 47*c*. In addition, contacts 49 into which the terminals 45*a*, 45*b* of the resistance body 40*a* and the collecting body 40*b* are inserted are formed in the non-circular portion 47*c*.

In addition, there are also shown a washer 50 interposed between the driving shaft 36 and the case 31, a sealing ring 51, an elastic arm 52 attached to the connector 47, an interlocking portion 53, a stopper portion 54 mounted on the cylindrical body 43, and lead wires 55.

The present embodiment is constructed as described above. Upon assembly of the throttle position sensor, the driving shaft 36 is inserted into and fitted in the attachment hole 34 of the case 31 via the spring 35. The wave washer 42 is inserted into the accommodating portion 32 from the opening 33 of the case 31. Then, the sliding-element receiver 37 on which the sliding elements 38*a*, 38*b* are mounted is fitted onto the driving shaft 36 in a state in which it is brought into sliding contact with the wave washer 42. Furthermore the insulating substrate 39 is fitted in the opening 33 in a state in which it is brought into sliding contact with the resistance body 40*a* the collecting body 40*b*.

The cover 41 is inserted into and fitted in the opening 33 so as to be brought into sliding contact with the insulating substrate 39. Thereafter, the insulating substrate 39 is brought into sliding contact with the step portion 31*a* by pressing the cover 41.

The thermosetting filler material 46 is next, charged into a region between the inner-wall face of the case 31 and the outer face of the cover 41 at the outside of the cover 41 in the opening 33, followed by the thermosetting. When the filler material 46 is heated for the thermohardening, air in the accommodating portion 32 is expanded. However, since the accommodating portion 32 is in a state in which it communicates with the outside through the air passage 44, the expanded air is reliably discharged to the outside, thereby avoiding an increase in pressure within the accommodating portion 32 and also avoiding the production of bubbles or the like in the thermosetting filler material 46.

After, after cooling of the thermosetting filler material 46, the connector 47 is press-fitted into the cylindrical body 43, and the hollow portion 43*a* of the cylindrical body 43 is blocked by the rubber packing 48 wound up on the cylindrical portion 47*b* of the connector 47. The interlocking portion 53 of the elastic arm 52 attached to the lead attachment portion 47*a* is then snap-fitted in the stopper portion 54 provided at the tip of the cylindrical body 43 in a state in which the terminals 45*a*, 45*b* are inserted into their associated connectors 49 at the tip portion of the cylindrical body 43.

As described above, the respective members of the throttle position sensor can fully be sealed tight with the thermosetting filler material 46 and the rubber packing 48, thereby making it possible to protect the respective members in the accommodating portion 32 from liquid and dust, and to stably activate the throttle position sensor.

According to the present invention, the hollow portion 43*a* may simply be sealed with the rubber packing 48 by press-fitting the connector 47 into the hollow portion 43*a* of the cylindrical body 43 after the thermosetting filler material 46 is charged into the region between the outer periphery of the cover 41 and the inner-wall face of the case 31 and subjected to thermohardening. It is therefore feasible to eliminate double resin-sealing work employed in the conventional example, so that its workability is superior to that in the conventional example.

In addition, the present invention can bring about an advantageous effect in that since the air passage 44 is defined in the outer side wall 31*b* of the case 31, the airtightness in the accommodating portion 32 can be checked by blowing high-pressurized air through the air passage 44 even after the opening 33 of the case 31 is sealed tight with the thermosetting filler material 46. Furthermore, the connector 47 can be used as a stopper for sealing the cylindrical body 43 and hence is effective in omitting the number of parts.

Having now fully described the invention, it will be apparent to those skilled in the art that many changes and modifications can be made without departing from the spirit or scope of the invention as set forth herein.

What is claimed is:

1. A sealing structure suitable for use in electrical parts, which comprises:

a casing having one end thereof defined as an opening face, an attachment hole defined in the other end thereof, and a hollow cylindrical body formed therein which extends at right angles to the side of said casing, said casing further having an air passage which is defined in the side thereof and communicates with a hollow portion of said cylindrical body;

a driving shaft having one end projecting from said attachment hole and rotatably mounted within said casing;

a sliding-element receiver attached to the other end of said driving shaft and rotated in response to the rotation of said driving shaft;

an insulating substrate disposed adjacent to said sliding-element receiver in said casing and in an opposing relationship thereto and having a conductive pattern formed on the surface of said insulating substrate, said conductive pattern disposed in an opposing relationship to said sliding-element receiver;

sliding elements mounted on said sliding-element receiver in such a manner that said sliding elements are brought into sliding contact with said insulating substrate in a face-to-face manner; and a connector having contacts whose outer side is provided with a sealing member mounted thereon and whose tip portions are received with terminals fixed to the conductive pattern inserted therein;

whereby a cover is fitted onto said opening face of said casing and a filler material is charged into a region between said cover and the inner-wall face of said casing, and an opening face of said cylindrical body is sealed tight with said sealing member after press-fitting of said connector into said cylindrical body.

2. The sealing structure as claimed in claim 1, wherein a sealing ring is provided between said driving shaft and said casing.

3. The sealing structure as claimed in claim 1, wherein said sealing member is a bellows-shaped rubber packing and serves to seal said opening face of said cylindrical body.

* * * * *